United States Patent [19]

Krasnov

[11] Patent Number: 4,793,422

[45] Date of Patent: Dec. 27, 1988

[54] ARTICULATED ELEVATOR LINKS FOR TOP DRIVE DRILL RIG

[75] Inventor: Igor Krasnov, Houston, Tex.

[73] Assignee: Hughes Tool Company - USA, Houston, Tex.

[21] Appl. No.: 168,833

[22] Filed: Mar. 16, 1988

[51] Int. Cl.[4] ..... E21B 19/06

[52] U.S. Cl. ..... 175/57; 175/85; 175/113; 294/90; 414/22.51

[58] Field of Search ..... 175/57, 85, 113, 52; 166/77.5, 85; 414/22, 745; 294/90

[56] References Cited

U.S. PATENT DOCUMENTS

| | | | |
|---|---|---|---|
| 3,464,507 | 9/1969 | Alexander et al. | 175/85 |
| 3,526,425 | 9/1970 | Langswski et al. | 414/22 X |
| 3,857,450 | 12/1974 | Guier | 175/85 |
| 3,915,244 | 10/1975 | Brown, deceased | 175/85 |
| 4,326,745 | 4/1982 | Guier | 414/22 X |
| 4,421,447 | 12/1983 | Gudgel et al. | 414/22 |
| 4,489,794 | 12/1984 | Boyadjieff | 175/85 |
| 4,625,796 | 12/1986 | Boyadjieff | 166/77.5 |
| 4,667,752 | 5/1987 | Berry et al. | 175/85 |

OTHER PUBLICATIONS

Maritime Hydraulics, "Power Swivel DDM-650 Derrick Drilling Machine"; Composite Catalog of Oil Field Equip. & Service, 1984–1985, pp. 5028-1 through 5028-4.

*Primary Examiner*—Hoang C. Dang
*Attorney, Agent, or Firm*—James E. Bradley

[57] ABSTRACT

An apparatus for a top drive drill rig lifts a stand of the drill pipe into engagement with the drive stem in the derrick. The apparatus includes a set of elevators mounted between the drive head by a link assembly. The link assembly includes two link sections connected together by a swivel joint. An upper hydraulic cylinder is connected between the drive head and the upper link section. A lower hydraulic cylinder is connected between the upper and lower link sections. These cylinders may be retracted to pull the stand of drill pipe upward into contact with the drive stem.

4 Claims, 2 Drawing Sheets

ARTICULATED ELEVATOR LINKS FOR TOP DRIVE DRILL RIG

BACKGROUND OF THE INVENTION

1. Field of the Invention

This invention relates in general to equipment for handling drill pipe on a drilling rig, and in particular to equipment for lifting drill pipe from the rig floor for connection to a power drive carried in the derrick.

2. Description of the Prior Art

A top drive drilling rig uses a driven drive stem carried in the derrick for rotating the drill pipe. This differs from the majority of drilling rigs, which have a driven rotary table on the rig floor through which a square kelly passes for rotating the drill pipe. One advantage of a top drive system is that it enables the driller to connect a triple stand of three joints or sections of drill pipe onto the top of the drill string. He then will drill the triple stand down to a point next to the rig floor, then add another triple stand. With conventional rotary table rigs, normally only a single joint can be drilled down at one time because of the length of the kelly.

One problem, however, with top drive drilling rigs is in connecting the stand of drill pipe to the drive stem. The drive stem will be more than ninety feet above the rig floor while making the connection. Normally the driller will lower the drive stem until it contacts the upper end of the stand. Then he will rotate the drive stem to secure it to the stand. A stabbing bell is mounted around the drive stem to align the drive stem with the stand as the drive stem is lowered onto the stand. Nevertheless, cross threading is not infrequent. This damages the threads.

One apparatus employed to avoid such occurrence is mounted in the derrick below the drive stem and is described in U.S. Pat. No. 4,667,752, Joe R. Berry et al., issued May-26, 1987. This device grabs a stand of drill pipe, picks it up and inserts it into engagement with the drive stem. While successful, the apparatus adds additional weight in the derrick and requires power to be supplied to the apparatus in the derrick. Pipe handling devices for mounting to a rig floor are known in general, but not specifically for top drive drilling rigs.

SUMMARY OF THE INVENTION

In this invention, an articulated link assembly connects the conventional elevators into the drive head assembly. The elevators releasably clamp around the drill pipe. The link assembly includes an upper link section and a lower link section. The upper link section is pivotally connected to the drive head assembly. The lower link section is pivotally to the elevator and at its upper end, pivotally connected to the lower end of the upper link section.

A lower hydraulic cylinder is connected between the upper and lower link sections. The lower hydraulic cylinder will pivot the lower link section about its swivel joint with the upper link section to raise the elevators.

An upper hydraulic cylinder is connected between the upper link section and the drive head assembly. The upper hydraulic cylinder will pivot the upper link assembly between an operative and a retracted position. In the retracted position, the elevators will be positioned to one side and disengaged from the drill pipe.

DETAILED DESCRIPTION OF THE INVENTION

Figure 1:
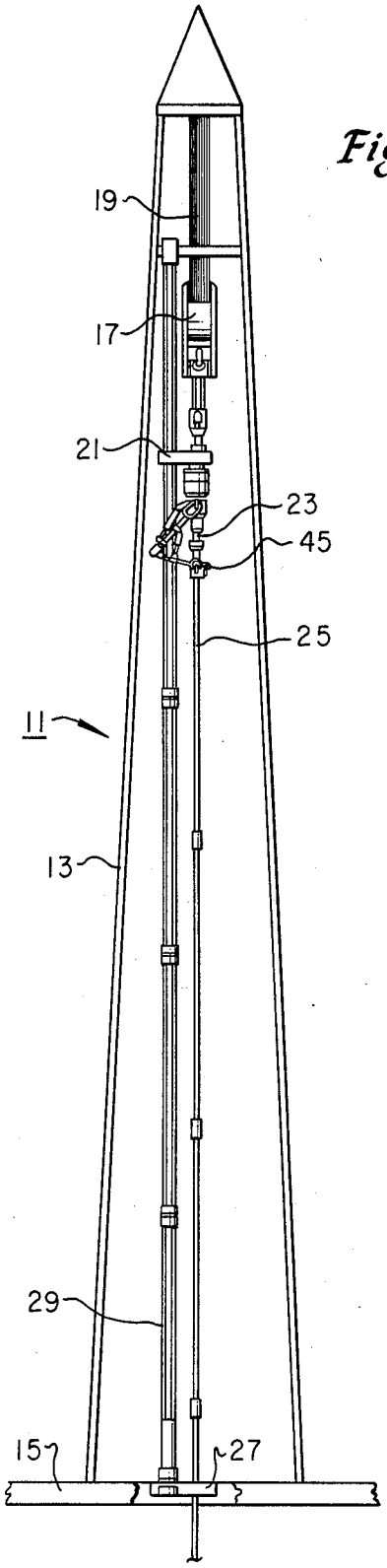
FIG. 1 is a side view schematically illustrating a drill rig having articulated links constructed in accordance with this invention.

With reference to FIG. 1, drill rig 11 has a derrick 13 extending above the rig floor 15. A set of blocks 17 are carried in the derrick 13 by cable 19. A drive head assembly 21 is suspended from the blocks 17.

The drive head assembly 21 is a top drive assembly, having a drive stem 23 that is rotated by the drive head assembly 21. The drive stem 23 connects to a string of drill pipe 25. The drill pipe 25 extends through a rotary table 27 at the rig floor 15 and into the well.

In this type of drill rig 11, the drive head assembly 21 is rotated by a drive shaft 29. The drive shaft 29 is a rectangular shaft that extends upward from the rig floor 15 into the derrick 13. A transmission (not shown) connects the drive shaft 29 to a power source, such as the rotary table 27, for rotating the drive shaft 29. The drive shaft 29 extends through a hole in the drive head assembly 21. The drive head assembly 21 will slide up and down relative to the drive shaft 29.

Figure 2:
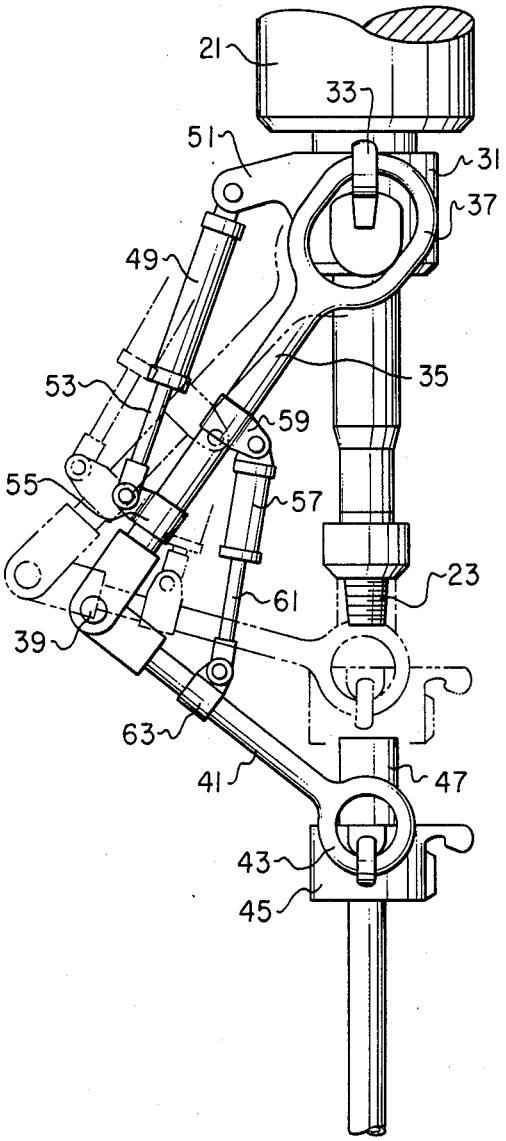
FIG. 2 is an enlarged side view of the articulated links of the drill rig in FIG. 1, showing them in a lifting position.
Figure 3:
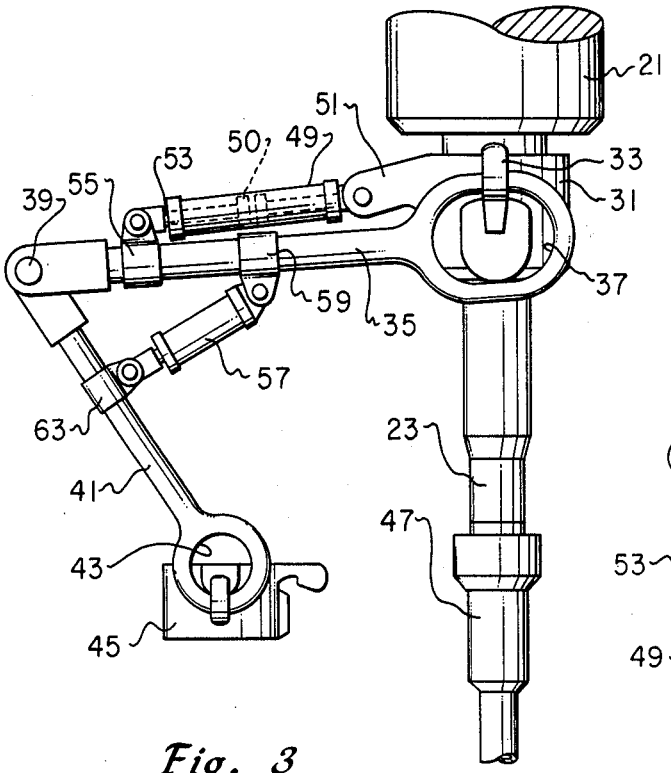
FIG. 3 is another side view of the articulated links, showing the links in a retracted position.

Referring to FIGS. 2 and 3, the drive head assembly 21 includes a link adapter 31. The link adapter 31 is a non-rotating portion of the drive head assembly 21. The link adapter 31 has an eye or hook 33 on each side (only one shown). An upper link section or arm 35 is pivotally connected to each eye 33. Each upper link section 35 is a rigid bar. Each upper link section 35 has a loop 37 on its upper end, which extends through the eye 33. Loop 37 allows the upper link section 35 to pivot or rotate about the eye 33. A swivel joint 39 is located on the lower end of each upper link section 35.

A lower link section 41 has its upper end connected to the swivel joint 39 of each upper link section 35. The lower link section 41 is also a rigid bar, but shorter in length than the upper link section 35. The lower link section 41 has a loop 43 on its lower end. A set of conventional elevators 45 are adapted to be coupled to the loops 43. The elevators 45 are of a type that will releasably clamp about a tool joint 47 of a section of the drill pipe 25.

Figure 4:
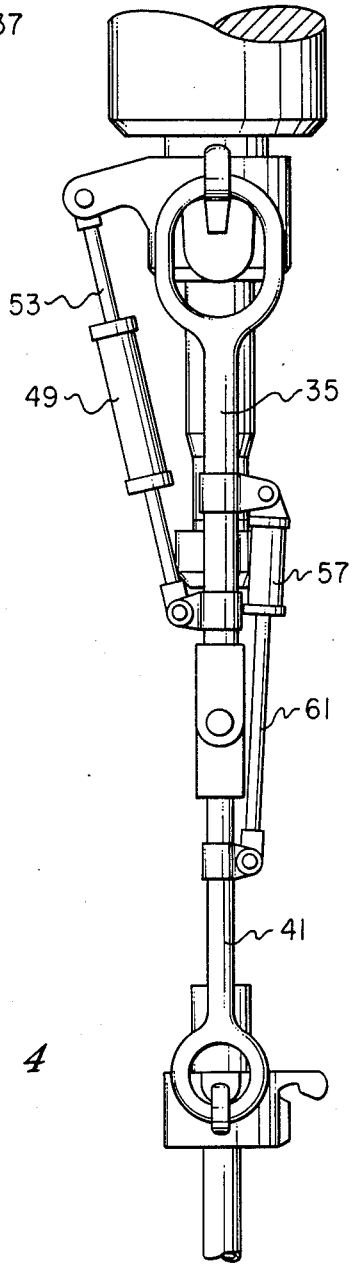
FIG. 4 is another side view of the articulated links, showing the links in an extended position.

The upper and lower link sections 35, 41 will pivot between the extended vertical position shown in FIG. 4, to the pipe lifting position shown in FIG. 2, and to the retracted position shown in FIG. 3. This is accomplished by hydraulic means that includes a pair of upper hydraulic cylinders 49 (only one shown). Each upper hydraulic cylinder 49, as shown in FIG. 4, has three fixed positions. Preferably each upper cylinder 49 has two pistons 50 in it, each having a piston rod 53 extending out of opposite ends of the cylinder 49. One of the piston rods 53 is connected to a stationary arm 51 which extends laterally outward from the link adapter 31. The other piston rod 53 is connected to a bracket 55 mounted to the upper link section 35 near the swivel joint 39. Alternately, rather than two piston rods 53 protruding from each end of each upper cylinder 49, each upper cylinder 49 could comprise two separate cylinders, connected together side-by-side, each having a single piston rod, but extending in opposite directions.

In FIG. 3, both of the piston rods 53 of each upper cylinder 49 are fully retracted. In FIG. 4, each piston rod 53 is fully extended. In FIG. 2, the upper piston rod 53 is fully retracted, while the lower piston rod 53 is fully extended. When both rods 53 are fully extended, each upper link section 35 is extending vertically downward parallel to the axis of the drive stem 23. When both piston rods 53 are fully retracted, as in FIG. 3, each upper link section 35 is at an angle of about 80 degrees relative to the axis of drive stem 23. When only one of the piston rods 53 is fully retracted, as shown by the dotted lines in FIG. 2, each upper link section 35 is at about a 45 degree angle relative to the axis of the drive stem 23.

A lower hydraulic cylinder 57 for each lower link section 41 has its upper end connected to a bracket 59. The bracket 59 is clamped to each upper link section 35 about halfway along its length. The lower hydraulic cylinder 57 has a single piston with a single piston rod 61 extending out the lower end. The piston rod 61 is connected to a bracket 63. Bracket 63 is clamped to the lower link section 41. Bracket 63 is located slightly closer to the swivel joint 39 than the loop 43. Lower hydraulic cylinders 57 will, when fully extended as shown in FIG. 4, allow the lower link sections 41 to be parallel with the upper link sections 35, and parallel with the axis of the drive stem 23. When fully retracted, as shown in FIG. 3, the angle between each upper link section 35 and lower link section 41 is about 10 degrees. FIG. 3 is not shown to scale.

In operation, the string of drill pipe 25 is rotated by the drive stem 23, which in turn is rotated by the drive head assembly 21. The drive head assembly 21 is driven by the drive shaft 29. During normal drilling, the elevators 45 will be loosely engaging the drill pipe 25. The drill pipe 25 will rotate relative to the elevators 45. The upper and lower link sections 35, 41, will be in the fully extended position shown in FIG. 4, parallel to the axis of the drive stem 23.

As the elevators 45 near the rig floor 15, a floor hand will release the elevators 45. The driller will close a valve to retract the lower hydraulic cylinders 57. At the same time, he closes a valve to retract both piston rods 53 of each upper hydraulic cylinder 49. This pivots the upper link sections 35 to a position only about 10 degrees from horizontal. The lower link sections 41 will pivot relative to the upper link sections 35 to the position shown in FIG. 3, forming an acute angle between the link sections 35, 41.

When the string of drill pipe 25 is drilled fully down, the driller will break out the drive stem 23 from the upper end of the drill pipe 25. The drill pipe 25 will be supported in slips (not shown) at the rotary table 27. After disconnection, the driller actuates the blocks 17 to pull the drive stem 23 up near the top of the derrick 13. The pressure will be relieved in the hydraulic cylinders 49, 57 to allow the piston rods 53, 61 to fully extend.

A stand of three sections of the drill pipe 25 will be made up in the mouse hole (not shown) of the drill rig 11. The derrick hand will close the elevators 45 around the upper end of the stand of drill pipe 25. The driller will pick up the blocks 17 and the stand of drillpipe 25 will be swung over to a point above the rotary table 27. The uppermost tool joint 47 of the string of drill pipe 25 will be spaced a few feet below the drive stem 23 and in alignment.

Then the driller actuates a valve to apply hydraulic fluid pressure to the lower hydraulic cylinders 57 and to one end of each upper hydraulic cylinder 49. This causes the piston rods 61 to retract and one piston rod 53 of each upper hydraulic cylinder 49 to retract. At the same time the upper piston rods 53 retract, the upper link sections 35 pivot upward about the eye 33, as shown in FIG. 2. The lower link sections 41 pivot upward about the swivel joints 39. The elevators 45 will move upward, lifting the stand of drill pipe 25. The dimensions of the link sections 35, 41 and the positions of the hydraulic cylinders 49, 57 are selected so that the elevators 45 will remain on the axis of the drive stem 23 as the cylinders 49, 51 are retracted.

The uppermost tool joint 47 of the drill pipe 25 will contact the drive stem 23 approximately the time that the upper piston rod 53 of each upper hydraulic cylinder 49 is fully retracted. The driller then will stop any movement of the piston rods 53, 61. He will rotate the drive stem 23 to make up the connection with the tool joint 47. Tongs (not shown) will be held on the stand of drill pipe 25 at the rig floor 15 as a backup during the making up operation.

The driller then releases pressure in the hydraulic cylinders 49, 51 allowing each to move to the extended position shown in FIG. 4. Drilling will then continue with rotation of the drive stem 23. The cycle will be repeated once the elevators 45 near the rig floor 15. When pulling pipe out of the well on a trip, the hydraulic cylinders 49, 57 will be extended as shown in FIG. 4. The weight of the string of drill pipe 25 will be supported by the link sections 35, 41 and not the cylinders 49, 57.

The invention has significant advantages. The articulated link assembly allows the driller to easily pull the stand into contact with the drive stem, even though the connection is made up ninety feet above the rig floor. This avoids damage to the threads of the drill pipe and drive stem.

While the invention has been shown in only one of its forms, it should be apparent to those skilled in the art that it is not so limited but is susceptible to various changes without departing from the scope of the invention.

I claim:

1. In a drill rig having a derrick, a drive head assembly suspended in the derrick having a drive stem for connection to and for rotating a string of drill pipe, an improved means for connecting a stand of the drill pipe to the drive stem, comprising in combination:

a pair of upper link sections, each pivotally suspended from the drive head assembly and having a lower end;

a pair of lower link sections, each having an upper end pivotally connected to one of the lower ends of the upper link sections and each having a lower end;

a set of elevators mounted to lower ends of the lower link sections for clamping about the stand of drill pipe;

upper lifting means connected between the upper link sections and the drive head assembly for pivoting the upper link sections relative to the drive head assembly; and lower lifting means connected between the upper and lower link sections for pivoting the lower link sections relative to the upper link sections for lifting the elevators upward relative to the drive head assembly to engage the stand of drill pipe with the drive stem.

2. In a drill rig having a derrick, a drive head assembly suspended in the derrick having a drive stem for connection to and for rotating a string of drill pipe, an improved means for connecting a stand of the drill pipe to the drive stem, comprising in combination:

a pair of upper link sections, each pivotally suspended from the drive head assembly and having a lower end;

a pair of lower link sections, each having an upper end pivotally connected by a swivel joint to one of the lower ends of the upper link sections and each having a lower end;

a set of elevators mounted to lower ends of the lower link sections for clamping about the stand of drill pipe;

upper lifting means connected between the upper link sections and the drive head assembly for pivoting the upper link sections relative to the drive head assembly between an extended position wherein the upper link sections are in substantial vertical alignment with the drive stem and a retracted position wherein the upper link sections extend transverse to the drive stem; and lower lifting means connected between the upper and lower link sections for pivoting the lower link sections about the swivel joints relative to the upper link sections between an extended position wherein the lower link sections are in substantial vertical alignment with the drive stem and a retracted position wherein the lower link sections are transverse to the drive stem, for lifting the elevators upward relative to the drive head assembly to engage the stand of drill pipe with the drive stem.

3. In a drill rig having a derrick, a drive head assembly suspended in the derrick having a drive stem for connection to and for rotating a string of drill pipe, an improved means for connecting a stand of the drill pipe to the drive stem, comprising in combination:

a pair of upper link sections, each pivotally suspended from the drive head assembly and having a lower end;

a pair of lower link sections, each having an upper end pivotally connected by a swivel joint to one of the lower ends of the upper link sections and each having a lower end;

a set of elevators mounted to lower ends of the lower link sections for clamping about the stand of drill pipe;

upper lifting means, including a hydraulic cylinder and piston connected between each of the upper link sections and the drive head assembly, for pivoting the upper link sections relative to the drive head assembly from an extended position substantially in vertical alignment with the drive stem to a semi-retracted position extending downward and outward from the drive stem and to a fully retracted position wherein the swivel joints are farther outward and higher from the other positions; and lower lifting means, including a hydraulic cylinder and piston connected between each of the upper and lower link sections, for pivoting the lower link sections about the swivel joints relative to the upper link sections from an extended position wherein the lower link sections extend downward substantially in vertical alignment with the drive stem while the upper link sections are in the extended position,to a retracted position at an acute angle relative to the upper link sections for lifting the stand of drill pipe while the upper link sections are moving to the semi-retracted position from the extended position.

4. In a drill rig having a derrick, a drive head assembly suspended in the derrick having a drive stem for connection to and for rotating a string of drill pipe, a method for connecting a stand of the drill pipe to the drive stem, comprising in combination the steps of:

pivotally suspending from the drive head assembly a pair of upper link sections;

pivotally connecting a pair of lower link sections to the upper link sections;

mounting a set of elevators to the lower link sections;

connecting between the drive head assembly and the upper link sections retractable upper lifting means for pivoting lower ends of the upper link sections relative to the drive head assembly;

connecting between the upper and lower link sections retractable lower lifting means for pivoting lower ends of the lower link sections upward relative to the upper link sections;

retracting the upper lifting means to extend the upper link sections downward and outward relative to the drive stem;

clamping the elevators to an upper end of the stand of drill pipe; then retracting the lower lifting means to pivot the lower ends of the lower link sections upward while continuing to retract the upper lifting means to lift the elevators substantially straight upward relative to the drive head assembly to engage the stand of drill pipe with the drive stem; then rotating the drive stem to connect the stand of drill pipe to the drive stem; then at a selected time, releasing the elevators from the stand of drill pipe, and fully retracting the upper and lower lifting means to move the elevators to one side of the drill stem.

* * * * *